US011313126B2

(12) United States Patent
Hanje

(10) Patent No.: US 11,313,126 B2
(45) Date of Patent: Apr. 26, 2022

(54) CONCRETE CORNER STRUCTURE WITH DIAGONALLY ORIENTED FIBER RESIN POLYMER REBAR

(71) Applicant: Carroll Distributing & Construction Supply, Inc., Cicero, IN (US)

(72) Inventor: Josh Hanje, Cicero, IN (US)

(73) Assignee: Tuf-N-Lite, LLC, Mason, OH (US)

( * ) Notice: Subject to any disclaimer, the term of this patent is extended or adjusted under 35 U.S.C. 154(b) by 0 days.

(21) Appl. No.: 17/235,032

(22) Filed: Apr. 20, 2021

(65) Prior Publication Data

US 2021/0340767 A1 Nov. 4, 2021

Related U.S. Application Data

(60) Provisional application No. 63/016,000, filed on Apr. 27, 2020.

(51) Int. Cl.
*E04C 5/07* (2006.01)
*E04B 2/86* (2006.01)

(52) U.S. Cl.
CPC ..... *E04C 5/073* (2013.01); *E04B 2/86* (2013.01); *E04B 2002/867* (2013.01); *E04B 2002/8676* (2013.01)

(58) Field of Classification Search
CPC ..... E04B 2/84; E04B 2/8605; E04B 2/86; E04B 2002/867; E04B 2002/8676; E04C 5/073
See application file for complete search history.

(56) References Cited

U.S. PATENT DOCUMENTS 1,053,231 A * 2/1913 Schweikert ..... 52/426
1,453,557 A * 5/1923 Wagner ..... E04B 2/8652 52/426
1,642,552 A * 9/1927 Millice ..... E05G 1/024 109/64
1,962,514 A * 6/1934 MacWilliam ..... E04B 2/10 52/715
3,717,967 A * 2/1973 Wood ..... E04B 2/54 52/259
4,047,691 A * 9/1977 Wolf ..... A01F 25/163 249/97

(Continued)

FOREIGN PATENT DOCUMENTS

CN 107217788 A * 9/2017
DE 3344038 A1 * 7/1985 ..... E04B 2/86

OTHER PUBLICATIONS

Code Requirements for Residential Concrete and Commentary, ACI Committee 332-08, Jun. 2008.

*Primary Examiner* — Jessie T Fonseca
(74) *Attorney, Agent, or Firm* — Overhauser Law Offices, LLC

(57) ABSTRACT

A concrete corner structure with diagonally oriented fiber resin polymer rebar and method that utilizes straight rebar to reinforce the corner structure. The straight rebar intersects with the horizontally disposed rebar in the first and second walls that form the corner structure. The straight rebar is placed at a 45-degree angle with respect to the two walls and tied to the horizontally disposed rebar. This allows for the use of straight rebar to reinforce the corner structure as opposed to a curved rebar.

3 Claims, 2 Drawing Sheets

(56) References Cited

U.S. PATENT DOCUMENTS

| | | | | | |
|---|---|---|---|---|---|
| 4,091,585 | A * | 5/1978 | Rudichuk | E04B 2/40 | 52/274 |
| 4,393,636 | A * | 7/1983 | Rockstead | E04B 5/32 | 52/381 |
| 4,433,520 | A * | 2/1984 | Maschhoff | E04B 2/32 | 52/275 |
| 4,916,879 | A * | 4/1990 | Boeshart | E04B 2/8652 | 249/40 |
| 5,599,599 | A | 2/1997 | Mirmiran | | |
| 5,658,483 | A * | 8/1997 | Boeshart | E04B 2/8652 | 249/191 |
| 8,096,094 | B2 * | 1/2012 | Mees | E04B 2/8617 | 52/742.14 |
| 2002/0116889 | A1 * | 8/2002 | Moore, Jr. | E04B 2/8641 | 52/426 |

* cited by examiner

CONCRETE CORNER STRUCTURE WITH DIAGONALLY ORIENTED FIBER RESIN POLYMER REBAR

CROSS REFERENCE TO RELATED APPLICATIONS

This application claims the benefit of U.S. Provisional Application No. 63/016,000 filed 27 Apr. 2020.

FIELD OF THE INVENTION

The present invention relates to poured concrete walls, and in particular, corners of walls that are reinforced with rebar.

BACKGROUND

It is known to reinforce concrete walls, including corners of walls, with rebar. Also known is rebar not made of steel, but of fiber reinforced polymer ("FRP"). Fiber reinforced plastic ("FRP")-concrete composite structural members are disclosed for example in U.S. Pat. No. 5,599,599.

It is known that concrete has excellent compressive strength to handle the loads and stresses imposed on structures created with concrete. It is known that concrete has poor tensile strength and thus a common practice is to give the concrete the needed tensile strength by placing reinforcing bars (rebar) prior to pouring. These rebars can include FRP rebar as well as steel rebar. It is known that to satisfy the load requirements imposed on concrete, a common practice is to bend or fabricate the rebar to meet load requirements.

Given the nature of thermoset composites, fabrication of FRP rebars can only occur at the manufacturing site which can be a time-consuming, expensive, and inconvenient process and necessitates expensive manufacturing machines. Steel rebar is fabricated either on or off the project site commonly with the help of hydraulic benders or done manually with the help of field-bending tools. Hydraulic benders are costly machines and the manual fabrication of steel rebar is time-consuming and laborious.

When reinforcing corners of concrete structures, such as basements of residential houses, it is common to use rebar that is curved. Such curved rebar extends along a first wall, curves as it passes through the intersection with a second wall, then extends along the second wall. While the use of curved rebar in corners has advantages in terms of strength, it has disadvantages. Curving rebar at a job site is a very time-consuming and expensive task, and requires special skills and equipment.

Moreover, FRP rebar cannot be bent at a job site. While it can be formed and cured with pre-existing curves of various radii, this would require a contractor to maintain a larger and more-varied inventory of rebar material both straight rebar and pre-curved rebar. The costs associated with ordering, inventorying and managing such additional rebar increases the overall costs of construction. It can also cause construction delays for time-sensitive jobs as FRP rebar manufacturers can experience delays in manufacturing or delivering products.

Building Code Requirements for Structural Concrete (ACI 318-14) and Commentary on Building Code Requirements for Structural Concrete (ACI 318R-14), both published by the American Concrete institute ("ACI"), set forth standards for structural concrete. Code Require is for Residential Concrete and Commentary are published by ACI in ACI 332-08.

SUMMARY OF THE INVENTION

One method for pouring concrete walls using straight rebar reinforcements comprises placing an outside corner concrete form along a foundation to form a first and second wall. The first and second walls form a rectangular intersection. Then, the user will place a plurality of vertical reinforcement poles in the foundation, a distance away from the outside concrete form. A plurality of horizontally disposed, straight rebar is then attached to the vertical reinforcement poles.

Next, a rebar, such as a fiber resin polymer (FRP) rebar or a steel rebar may be placed in a manner that t intersects with the horizontally disposed rebar in the first and second walls at a 45-degree angle to each. The rebar has a length such that a first end of the rebar extends outside the rectangular intersection and into the first wall. A second end of the rebar extends outside the rectangular intersection and into the second wall. The rebar is connected to the horizontally disposed rebar with ties or some other connection means. Then a concrete cover is placed a distance away from the horizontally disposed rebar, opposite the concrete form. Finally, the concrete is poured between the concrete form and concrete cover to form the first and second walls.

Further disclosed is a unique placement of fiber reinforced polymer (FRP) rebar in the corner of a concrete wall, such that the piece of rebar is at an approximate 45 degree angle with respect to the sides of each wall and positioned within the corner so that the ends of the rebar extend outside the intersection of the adjoining walls as shown in FIGS. 1 and 2. The walls that come together to form the corner also have horizontally displaced rebar extending into the intersection. The invention avoids the need to bend rebar at a construction site, or to acquire pre-bent rebar and transport it to the construction site.

DETAILED DESCRIPTION

Unlike steel rebar, FRP rebar does not corrode, and avoids other limitations of steel rebar. These limitations include: weight, corrosiveness, high stiffness, limited fatigue resistance (cyclic loading), high thermal and electrical conductivity and high maintenance for black-steel, galvanized, and epoxy-coated rebar.

Glass fiber reinforced polymer (GFRP) rebar, such as MST-BAR® & MFX-BAR® GFRP rebar is available from B&B FRP Manufacturing Inc., 20 Haulm Road, Woodbridge, Ontario, Canada L4L, 3P6. FRP rebar is especially suitable for applications where steel rebar is limited to its properties, such as in humid, coastal, and cold areas. FRP rebar eliminates corrosion problem and costs associated with corrosion and maintenance. FRP rebar has higher strength, and better adheres to concrete than steel rebar. FRP rebar may reduce the cost of a project up to 5% as the structure does not require major maintenance for 100 years.

Figure 1:
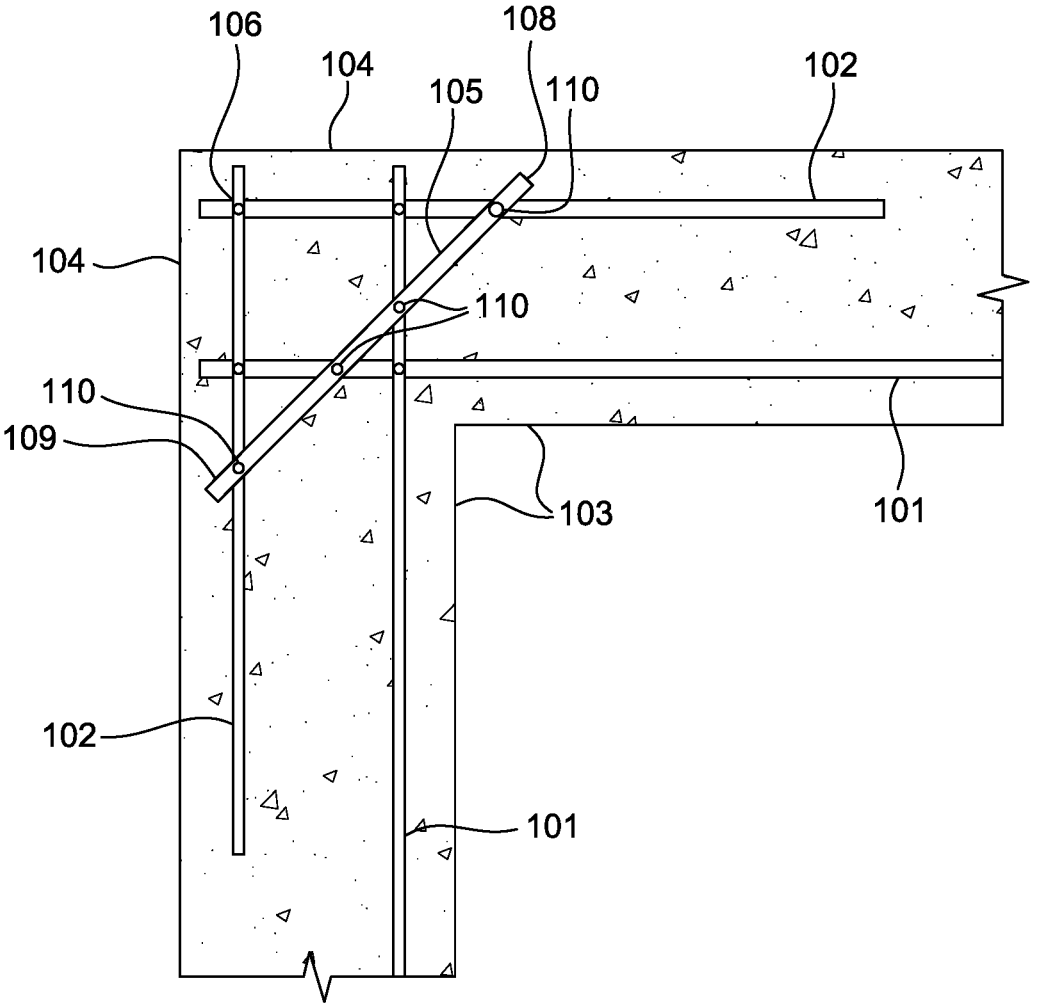
FIG. 1 shows an application of the invention for a wall.

FIG. 1 is an overhead view of an application of the invention for a wall, such as for a residential basement wall corner. If each wall is 10" wide they form an intersection that is a 10" square. Each wall has a primary 101 and secondary (but optional) horizontal rebar 102 that are parallel to the sides of the wall. The primary rebar 101 is about 1.5 inches from the interior sides of the wall 103, and extends far outside of the wall intersection. The secondary rebar 102 is 20" in length, and about 1.5 inches from the exterior (backfill) side of the wall 104, and extends about 10 inches outside of the wall intersection. The diagonal FRP rebar 105 is at a 45-degree angle and laid so it is adjacent to or crosses the primary 101 and secondary rebus 102 of each all. The FRP diagonal rebar 105 is about 17 inches in length and positioned 9.5 inches from the exterior corner of the intersection 106.

FIG. 1 may also show an application of the invention for an 8" thick wall. The only difference between this 8" thick wall and the 10" thick wall is that the diagonal FRP rebar 105 is 13 inches in length and spaced from the exterior corner of the intersection 106 by 7.5 inches. In both examples, FRP rebar is used. This provides significant advantages as compared to steel rebar. Steel rebar will stretch and yield, but FRP rebar will not stretch as much and has greater bond strength. The FRP rebar may be comprised of basalt fiber, carbon fiber, aramid fiber, glass fiber, or any combination of the foregoing or their functional equivalents.

Figure 2:
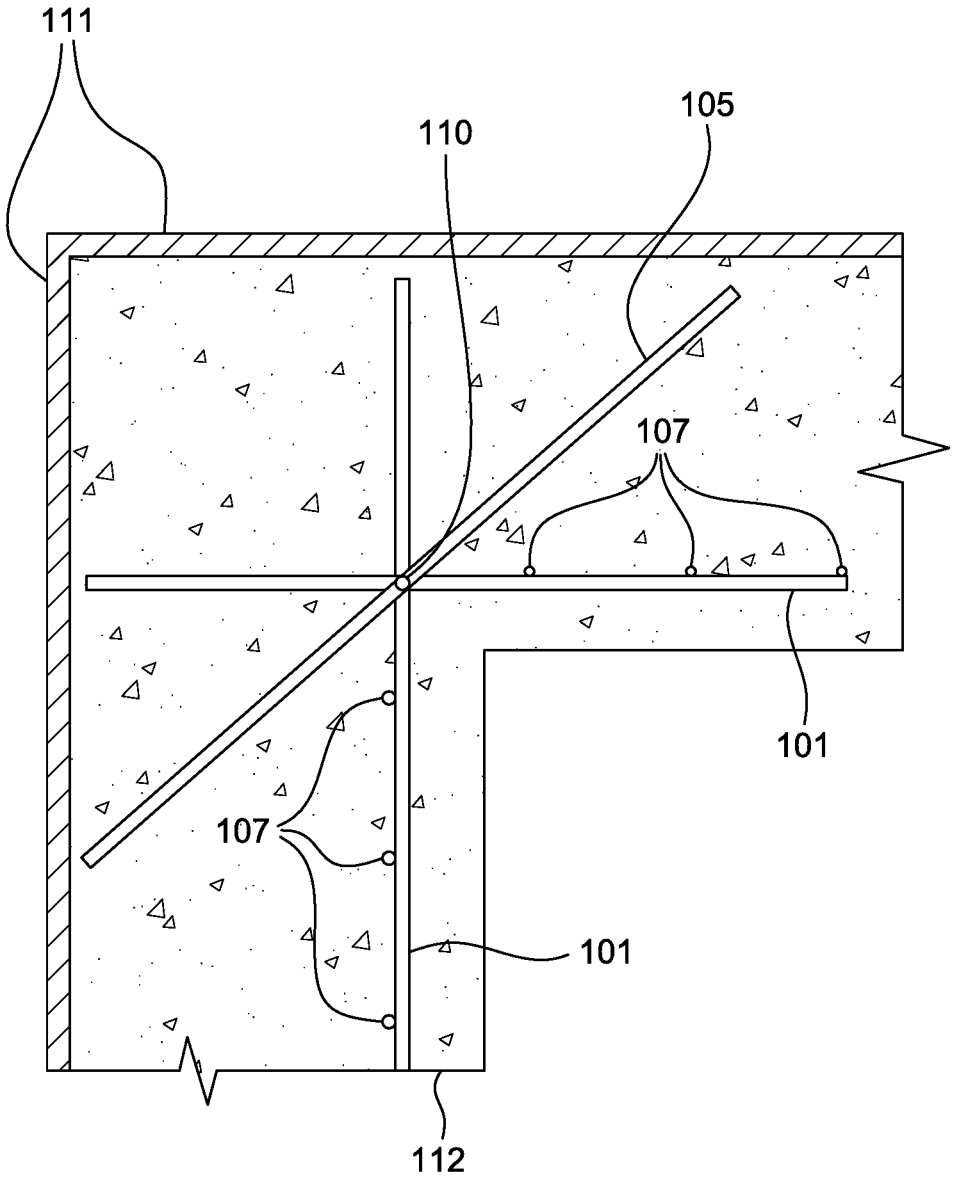
FIG. 2 shows how a diagonal fiber reinforced polymer (FRP) rebar may instead be positioned so that it the intersects with the two primary rebars at the location where those primary rebars intersect.

In an alternate embodiment, the diagonal GFRP rebar 105 may instead be positioned so that it intersects with the two primary rebars 101 at the location where those primary rebars 101 intersect, as shown in FIG. 2.

To use the above inventive placement of straight rebar reinforcements instead of curved rebar, a user can start by placing an outside corner concrete form 111 along a foundation to form a first and second wall. The first and second walls form a rectangular intersection. Then, the user will place a plurality of vertical reinforcement poles 107 in the foundation, a distance away from the outside concrete form as shown in FIG. 2. A plurality of horizontally disposed straight rebar 101, 102 is then attached to the vertical reinforcement poles.

Next, an FRP rebar 105 may be placed in a manner that it intersects with the horizontally disposed rebar 101, 102 in the first and second walls at a 45-degree angle to each. The rebar 105 has a length such that a first end of the rebar 108 extends outside the rectangular intersection and into the first wall. A second end of the rebar 109 extends outside the rectangular intersection and into the second wall. The rebar is connected to the horizontally disposed rebar 101, 102 with ties or some other connection means 110. Then a concrete cover 112 is placed a distance away from the horizontally disposed rebar 101, opposite the concrete form 111. Finally, the concrete is poured between the concrete form 111 and concrete cover 112 to form the first and second walls.

In the disclosed embodiments the rebar may comprise #3 (GFRP rebar, such as MST-BAR® available from B&B FRP Manufacturing Inc.

Multiple vertical spacings of the GFRP rebar may be made, depending on how tall and long the wall is and the soil load against the wall, as shown by the following:

| 8-inch flat basement walls analyzed as rectangular plates with simply supported edges | | | | | | | |
|---|---|---|---|---|---|---|---|
| Wall height = | | 8 ft | | | | | |
| Backfill height = | | 7 ft | | | | | |
| Bar location = | | 1.5 inches clear cover from tension (interior) face | | | | | |
| | | Soil Equivalent Unit Density | | | | | |
| | | 30 psf/ft MST-BAR #3spacing. | | 45 psf/ft MST-BAR #3 spacing. | | 60 psf/ft MST-BAR #3 spacing. | |
| wall ratio | ft | Horizontal | Vertical | Horizontal | Vertical | Horizontal | Vertical |
| 1 | 8 | * | 91 | * | 60 | * | 52 |
| 1.5 | 12 | * | 56 | * | 37 | * | 28 |
| 2 | 16 | * | 44 | * | 29 | * | 22 |
| 3 | 24 | * | 40 | * | 26 | * | 20 |
| 4 | 32 | * | 38 | * | 25 | * | 19 |

*One #3 horizontal bar within 12 inches from the top of wall and one #3 horizontal bar placed at mid-height on the wall.

| Wall height = | | 8 ft | | | | | |
|---|---|---|---|---|---|---|---|
| Backfill height = | | 7 ft | | | | | |
| Bar location = | | 1.5 inches clear cover from tension (interior) face | | | | | |
| | | Soil Equivalent Unit Density | | | | | |
| | | 30 psf/ft MST-BAR #3spacing. | | 45 psf/ft MST-BAR #3 spacing. | | 60 psf/ft MST-BAR #3 spacing. | |
| wall ratio | ft | Horizontal | Vertical | Horizontal | Vertical | Horizontal | Vertical |
| 1 | 8 | * | 69 | * | 46 | 37 | 34 |
| 1.5 | 12 | * | 42 | * | 28 | 37 | 21 |
| 2 | 16 | * | 34 | * | 22 | 41 | 17 |
| 3 | 24 | * | 30 | * | 20 | * | 15 |
| 4 | 32 | * | 29 | * | 29 | * | 14 |

*One #3 horizontal bar within 12 inches from the top of wall and two #3 horizontal bar placed at mid-height on the wall.

-continued

| 8-inch flat basement walls analyzed as rectangular plates with simply supported edges | | | | | | | |
|---|---|---|---|---|---|---|---|
| Wall height = | | 9 ft | | | | | |
| Backfill height = | | 8 ft | | | | | |
| Bar location = | | 1.5 inches clear cover from tension (interior) face | | | | | |
| | | Soil Equivalent Unit Density | | | | | |
| | wall length, | 30 psf/ft MST-BAR #3spacing. | | 45 psf/ft MST-BAR #3 spacing. | | 60 psf/ft MST-BAR #3 spacing. | |
| wall ratio | ft | Horizontal | Vertical | Horizontal | Vertical | Horizontal | Vertical |
| 1 | 9 | * | 62 | * | 46 | * | 31 |
| 1.5 | 13.5 | * | 38 | * | 28 | * | 19 |
| 2 | 18 | * | 30 | * | 22 | * | 15 |
| 3 | 27 | * | 27 | * | 20 | * | 13 |
| 4 | 36 | * | 26 | * | 19 | * | 13 |

*One #3 horizontal bar within 12 inches from the top of wall and two #3 horizontal bar placed at third points on the wall.

| | | | | | | | |
|---|---|---|---|---|---|---|---|
| Wall height = | | 9 ft | | | | | |
| Backfill height = | | 9 ft | | | | | |
| Bar location= | | 1.5 inches clear cover from tension (interior) face | | | | | |
| | | Soil Equivalent Unit Density | | | | | |
| | wall length, | 30 psf/ft MST-BAR #3spacing. | | 45 psf/ft MST-BAR #3 spacing. | | 60 psf/ft MST-BAR #3 spacing. | |
| wall ratio | ft | Horizontal | Vertical | Horizontal | Vertical | Horizontal | Vertical |
| 1 | 9 | * | 49 | * | 32 | 26 | 24 |
| 1.5 | 13.5 | * | 30 | * | 20 | 26 | 15 |
| 2 | 18 | * | 24 | * | 16 | 29 | 12 |
| 3 | 27 | * | 21 | * | 14 | * | 10 |
| 4 | 36 | * | 20 | * | 13 | * | 10 |

*One #3 horizontal bar within 12 inches from the top of wall and two #3 horizontal bar placed at third points on the wall.

| 10-inch flat basement walls analyzed as rectangular plates with simply supported edges | | | | | | | |
|---|---|---|---|---|---|---|---|
| Wall height = | | 8 ft | | | | | |
| Backfill height = | | 7 ft | | | | | |
| Bar location = | | 1.5 inches clear cover from tension (interior) face | | | | | |
| | | Soil Equivalent Unit Density | | | | | |
| | | 30 psf/ft MST-BAR #3spacing. | | 45 psf/ft MST-BAR #3 spacing. | | 60 psf/ft MST-BAR #3 spacing. | |
| wall ratio | ft | Horizontal | Vertical | Horizontal | Vertical | Horizontal | Vertical |
| 1 | 8 | * | 120 | * | 80 | * | 60 |
| 1.5 | 12 | * | 73 | * | 49 | * | 36 |
| 2 | 16 | * | 59 | * | 39 | * | 39 |
| 3 | 24 | * | 53 | * | 35 | * | 36 |
| 4 | 32 | * | 50 | * | 33 | * | 25 |

*One #3 horizontal bar within 12 inches from the top of wall and one #3 horizontal bar placed at mid-height on the wall.

-continued

| 10-inch flat basement walls analyzed as rectangular plates with simply supported edges | | | | | | | |
|---|---|---|---|---|---|---|---|
| Wall height = | | 8 ft | | | | | |
| Backfill height = | | 8 ft | | | | | |
| Bar location = | | 1.5 inches clear cover from tension (interior) face | | | | | |
| | | Soil Equivalent Unit Density | | | | | |
| | | 30 psf/ft MST-BAR #3spacing. | | 45 psf/ft MST-BAR #3 spacing. | | 60 psf/ft MST-BAR #3 spacing. | |
| wall ratio | ft | Horizontal | Vertical | Horizontal | Vertical | Horizontal | Vertical |
| 1 | 8 | * | 92 | * | 61 | * | 46 |
| 1.5 | 12 | * | 56 | * | 37 | * | 28 |
| 2 | 16 | * | 45 | * | 30 | * | 22 |
| 3 | 24 | * | 40 | * | 27 | * | 20 |
| 4 | 32 | * | 38 | * | 25 | * | 19 |

*One #3 horizontal bar within 12 inches from the top of wall and one #3 horizontal bar placed at mid-height on the wall.

| | | | | | | | |
|---|---|---|---|---|---|---|---|
| Wall height = | | 9 ft | | | | | |
| Backfill height = | | 8 ft | | | | | |
| Bar location = | | 1.5 inches clear cover from tension (interior) face | | | | | |
| | | Soil Equivalent Unit Density | | | | | |
| | wall length, | 30 psf/ft MST-BAR #3spacing. | | 45 psf/ft MST-BAR #3 spacing. | | 60 psf/ft MST-BAR #3 spacing. | |
| wall ratio | ft | Horizontal | Vertical | Horizontal | Vertical | Horizontal | Vertical |
| 1 | 9 | * | 81 | * | 54 | * | 40 |
| 1.3 | 13.5 | * | 50 | * | 33 | * | 25 |
| 2 | 18 | * | 40 | * | 26 | * | 20 |
| 3 | 27 | * | 36 | * | 24 | * | 18 |
| 4 | 36 | * | 34 | * | 22 | * | 17 |

*One #3 horizontal bar within 12 inches from the top of wall and two #3 horizontal bar placed at third points on the wall.

| | | | | | | | |
|---|---|---|---|---|---|---|---|
| Wall height = | | 9 ft | | | | | |
| Backfill height = | | 9 ft | | | | | |
| Bar location = | | 1.5 inches clear cover from tension (interior) face | | | | | |
| | | Soil Equivalent Unit Density | | | | | |
| | wall length, | 30 psf/ft MST-BAR #3spacing. | | 45 psf/ft MST-BAR #3 spacing. | | 60 psf/ft MST-BAR #3 spacing. | |
| wall ratio | ft | Horizontal | Vertical | Horizontal | Vertical | Horizontal | Vertical |
| 1 | 9 | * | 64 | * | 43 | * | 32 |
| 1.5 | 13.5 | * | 39 | * | 26 | * | 19 |
| 2 | 18 | * | 31 | * | 21 | * | 15 |
| 3 | 27 | * | 28 | * | 19 | * | 14 |
| 4 | 36 | * | 27 | * | 18 | * | 13 |

*One #3 horizontal bar within 12 inches from the top of wall and two #3 horizontal bar placed at third points on the wall.

Alternatively, these spacings for the vertical rebar may be utilized for walls with heights of 8, 9 or 10 ft.:

| MAX BACKFILL HT. | WALL LENGTH | VERT. BAR SPACING |
|---|---|---|
| 7 FT | <8 FT | 4EQ @ 48" O.C. |
| | 8 FT-12 FT | 4EQ @ 36" O.C. |
| | 12 FT+ | 4EQ @ 24" O.C. |
| 8 FT | <8 FT | 4EQ @ 42" O.C. |
| | 8 FT-12 FT | 4EQ @ 30" O.C. |
| | 12 FT-24 FT | 4EQ @ 20" O.C. |
| | 24 FT+ | 4EQ @ 18" O.C. |

-continued

| MAX BACKFILL HT. | WALL LENGTH | VERT. BAR SPACING |
|---|---|---|
| 8 FT | <9 FT | 4EQ @ 42" O.C. |
| | 9 FT-15 FT | 4EQ @ 24" O.C. |
| | 15 FT+ | 4EQ @ 18" O.C. |
| 9 FT | <9 FT | 4EQ @ 32" O.C. |
| | 9 FT-15 FT | 4EQ @ 18" O.C. |
| | 15 FT-27 FT | 4EQ @ 16" O.C. |
| | 27 FT+ | 4EQ @ 12" O.C. |

-continued

| MAX BACKFILL HT. | WALL LENGTH | VERT. BAR SPACING |
|---|---|---|
| 9 FT | <10 FT | 4EQ @ 24" O.C. |
| | 10 FT-15 FT | 4EQ @ 12" O.C. |
| | 15 FT+ | 4EQ @ 9" O.C. |
| 10 FT | <10 FT | 4EQ @ 18" O.C. |
| | 10 FT-15 FT | 4EQ @ 12" O.C. |
| | 15 FT-20 FT | 4EQ @ 9" O.C. |
| | 20 FT+ | 4EQ @ 6" O.C. |

Those of skill in the art will understand that various details of the invention may be changed without departing from the spirit and scope of the invention. Furthermore, the foregoing description is for illustration only, and not for the purpose of limitation, the invention being defined by the claims.

While the invention has been illustrated and described in detail in the foregoing drawings and description, the same is to be considered as illustrative and not restrictive in character, it being understood that only illustrative embodiments thereof have been show and described and that all changes and modifications that are within the scope of the following claims are desired to be protected.

All references cited in this specification are incorporated herein by reference to the extent that they supplement, explain, provide a background for or teach methodology or techniques employed herein, including Building Code Requirements for Structural Concrete (ACI 318-14), and Commentary on Building Code Requirements for Structural Concrete (ACI 318R-14) and Code Requirements for Residential Concrete and Commentary, all published by the American Concrete Institute ("ACI").

What is claimed is:

1. A method for pouring concrete walls using straight rebar reinforcements comprising:

placing an outside corner concrete form along a foundation to form a first and second wall that form a rectangular intersection;

placing a plurality of vertical reinforcement poles in the foundation a distance away from the outside corner concrete form;

attaching a plurality of straight, horizontally disposed, rebar to the vertical reinforcement poles;

attaching a fiber resin polymer (FRP) rebar that:

intersects with the horizontally disposed rebar in the first and second walls at a 45-degree angle to each horizontally disposed rebar, has a length such that a first end of the FRP rebar extends outside the rectangular intersection and into the first wall, and a second end of the FRP rebar extends outside the rectangular intersection and into the second wall;

connecting the FRP rebar to the horizontally disposed rebar at each point in which they intersect;

placing a concrete cover at a distance away from the horizontally disposed rebar opposite the concrete form;

pouring concrete between the concrete form and concrete cover to form the first and second walls.

2. A method for pouring concrete walls using straight rebar reinforcements comprising:

placing an outside corner concrete form along a foundation to form a first and second wall that form a rectangular intersection;

placing a plurality of vertical reinforcement poles in the foundation a distance away from the outside corner concrete form;

attaching a plurality of straight, horizontally disposed, rebar to the vertical reinforcement poles;

attaching a straight rebar that:

intersects with the horizontally disposed rebar in the first and second walls at a 45-degree angle to each horizontally disposed rebar, has a length such that a first end of the straight rebar extends outside the rectangular intersection and into the first wall, and a second end of the straight rebar extends outside the rectangular intersection and into the second wall;

connecting the straight rebar to the horizontally disposed rebar at each point in which they intersect;

placing a concrete cover at a distance away from the horizontally disposed rebar opposite the concrete form;

pouring concrete between the concrete form and concrete cover to form the first and second walls.

3. The method for pouring concrete walls of claim 2 wherein the straight rebar is comprised of fiber resin polymer (FRP).

* * * * *